US008092093B2

(12) United States Patent
Fang et al.

(10) Patent No.: US 8,092,093 B2
(45) Date of Patent: Jan. 10, 2012

(54) DYNAMIC IMPELLER OIL SEAL

(75) Inventors: Ning Fang, West Chester, OH (US); Ray Harris Kinnaird, Ft. Thomas, KY (US); Gary Paul Moscarino, Cincinnati, OH (US); Kenneth Lee Fisher, Blue Ash, OH (US); Jonothan Allen Scheetz, Waynesville, OH (US); Dave William Pugh, Fairfield, OH (US); Edward William Grace, Cincinnati, OH (US); Duane Howard Anstead, Faifield, OH (US); Bala Corattiyil, Montgomery, OH (US); Prasad Laxman Kane, Pune (IN)

(73) Assignee: General Electric Company, Schenectady, NY (US)

( * ) Notice: Subject to any disclaimer, the term of this patent is extended or adjusted under 35 U.S.C. 154(b) by 758 days.

(21) Appl. No.: 12/183,547

(22) Filed: Jul. 31, 2008

(65) Prior Publication Data

US 2010/0027926 A1 Feb. 4, 2010

(51) Int. Cl.
*F16C 33/80* (2006.01)

(52) U.S. Cl. ..... 384/477; 384/478; 277/423

(58) Field of Classification Search ..... 384/477, 384/465, 466, 471, 472, 478, 479; 277/411, 277/412, 423; 415/173.5, 174.5
See application file for complete search history.

(56) References Cited

U.S. PATENT DOCUMENTS

| | | | | |
|---|---|---|---|---|
| 4,046,223 | A | 9/1977 | McHugh | |
| 5,052,828 | A | 10/1991 | Ciokajlo et al. | |
| 5,201,845 | A | 4/1993 | Allmon et al. | |
| 5,257,903 | A | 11/1993 | Allmon et al. | |
| 5,746,574 | A | 5/1998 | Czachor et al. | |
| 6,131,914 | A * | 10/2000 | Proveaux | 277/412 |
| 6,470,666 | B1 | 10/2002 | Przytulski et al. | |
| 6,910,863 | B2 | 6/2005 | Scardicchio et al. | |
| 7,241,109 | B2 * | 7/2007 | Ferra | 415/174.5 |
| 7,458,202 | B2 | 12/2008 | Moniz et al. | |
| 7,530,870 | B2 * | 5/2009 | Kishimoto et al. | 277/423 |
| 7,574,854 | B2 | 8/2009 | Moniz | |
| 7,603,844 | B2 | 10/2009 | Moniz et al. | |
| 7,625,177 | B2 * | 12/2009 | Ivakitch | 415/173.4 |

* cited by examiner

*Primary Examiner* — Thomas R Hannon
(74) *Attorney, Agent, or Firm* — David J. Clement, Esq.; Trego, Hines & Ladenheim, PLLC

(57) ABSTRACT

A rotating seal for a gas turbine engine includes: (a) an annular seal body; (b) a sealing component carried by the seal body which is adapted to form one-half of a rotating seal interface; and (c) an impeller carried by the seal body which comprises a plurality of radially-inwardly-extending impeller blades.

18 Claims, 6 Drawing Sheets

DYNAMIC IMPELLER OIL SEAL

BACKGROUND OF THE INVENTION

This invention relates generally to gas turbine engine bearing sumps and more particularly to control of oil flow in bearing sumps.

A gas turbine engine includes one or more shafts which are mounted for rotation in several bearings, usually of the rolling-element type. The bearings are enclosed in enclosures called "sumps" which are pressurized and provided with an oil flow for lubrication and cooling. In most cases one of the boundaries of the sump will be a dynamic seal between a rotating component of the engine and the engine's stationary structure.

Many dynamic seals, such as carbon seals, require secondary seals to prevent oil leakage past the primary sealing surface. A device called a "windback" comprising a helical thread and mating rotating surface is frequently used. The windage caused by the rotating surface pushes the oil mist away from the interface, causing any oil accumulated within the helical thread to be driven through the thread groove back into the sealed cavity. The axial component of windage generated by the air shearing acts as a driving force to keep oil mist away. The tangential component of windage pushes oil collected at the bottom of helical thread back into sealed cavity. Windage is a secondary effect of shaft rotation and its effectiveness strongly depends on shaft speed and the radial gap between rotating and stationary parts.

In a prior art windback, the grooves between the teeth are at the same diameter; there are no axial or tangential angles to facilitate oil drainage. The pitch of the thread is relatively small compared to the diameter, therefore, the axial windage effect is limited. Furthermore, oil collected at the thread root has to travel through the total length of the thread circumference. Oil collected must overcome gravity to return back to oil-wetted cavity if the shaft axis is horizontal. Under conditions where the windage is not adequate to drive oil completely around circumference of the thread and back to the oil-wetted cavity, oil leakage might occur. Windback effectiveness is usually difficult to predict. If oil/air mist passes the secondary seal, performance of the primary seal is jeopardized.

BRIEF SUMMARY OF THE INVENTION

These and other shortcomings of the prior art are addressed by the present invention, which provides a rotating seal incorporating an impeller which moves oil mist away from a seal interface using centrifugal force.

According to one aspect, a rotating seal for a gas turbine engine includes: (a) an annular seal body; (b) a sealing component carried by the seal body which is adapted to form one-half of a rotating seal interface; and (c) an impeller carried by the seal body which comprises a plurality of radially-inwardly-extending impeller blades.

According to another aspect of the invention, a bearing assembly for a gas turbine includes: (a) a rolling element bearing enclosed in a wet cavity; (b) a stationary component forming a portion of a boundary between the wet cavity and a dry cavity; (c) a rotating component disposed adjacent the stationary component and forming a portion of the boundary between the wet cavity and the dry cavity, wherein the stationary and rotating components cooperate to define a rotating seal interface between the wet and dry cavities; and (d) an impeller carried by the rotating component which comprises a plurality of radially-extending impeller blades adapted to move oil away from the seal interface towards the wet cavity.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
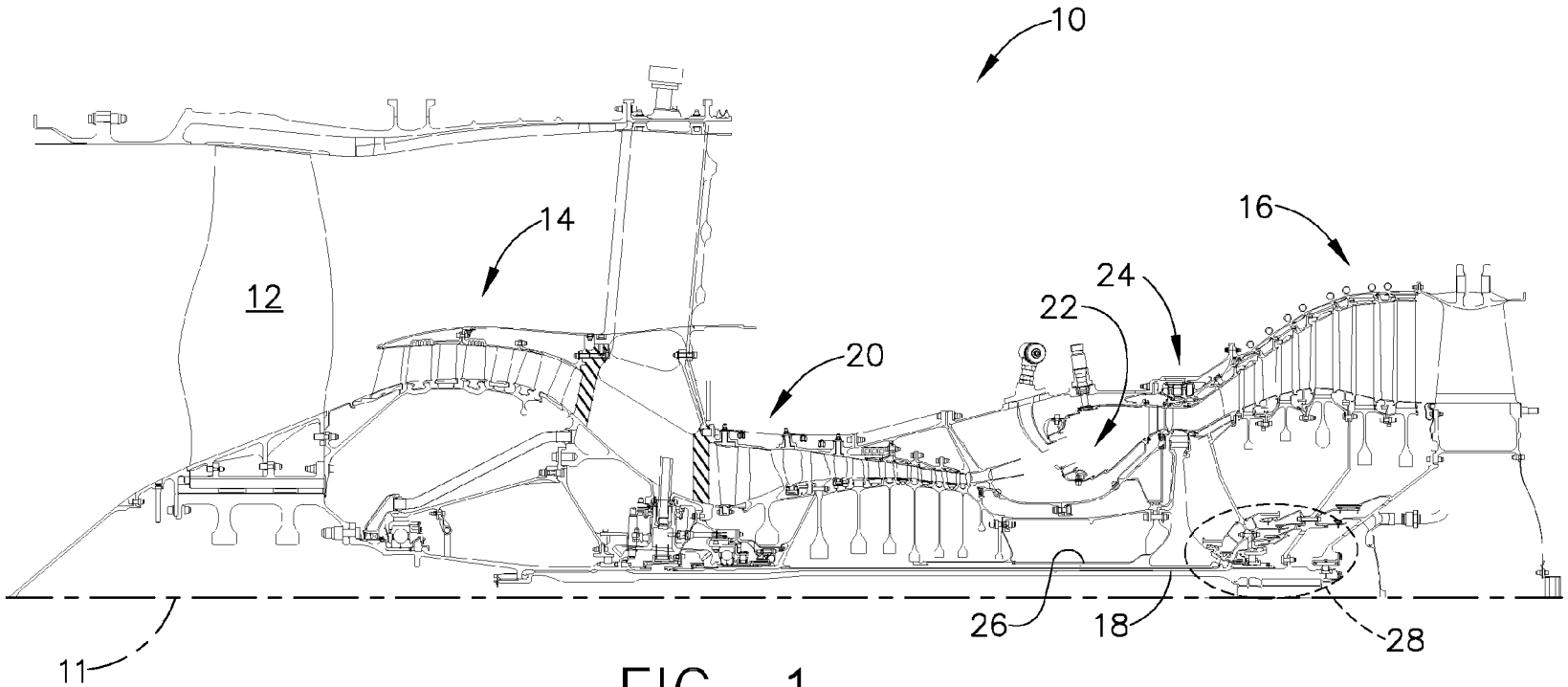
FIG. 1 is a half-sectional view of a gas turbine engine incorporating a rotating oil seal constructed according to an aspect of the present invention.

Referring to the drawings wherein identical reference numerals denote the same elements throughout the various views, FIG. 1 depicts a gas turbine engine 10. The engine 10 has a longitudinal axis 11 and includes a fan 12, a low pressure compressor or "booster" 14 and a low pressure turbine ("LPT") 16 collectively referred to as a "low pressure system". The LPT 16 drives the fan 12 and booster 14 through an inner shaft 18, also referred to as an "LP shaft". The engine 10 also includes a high pressure compressor ("HPC") 20, a combustor 22, and a high pressure turbine ("HPT") 24, collectively referred to as a "gas generator" or "core". The HPT 24 drives the HPC 20 through an outer shaft 26, also referred to as an "HP shaft". Together, the high and low pressure systems are operable in a known manner to generate a primary or core flow as well as a fan flow or bypass flow. While the illustrated engine 10 is a high-bypass turbofan engine, the principles described herein are equally applicable to turboprop, turbojet, and turboshaft engines, as well as turbine engines used for other vehicles or in stationary applications.

Figure 2:
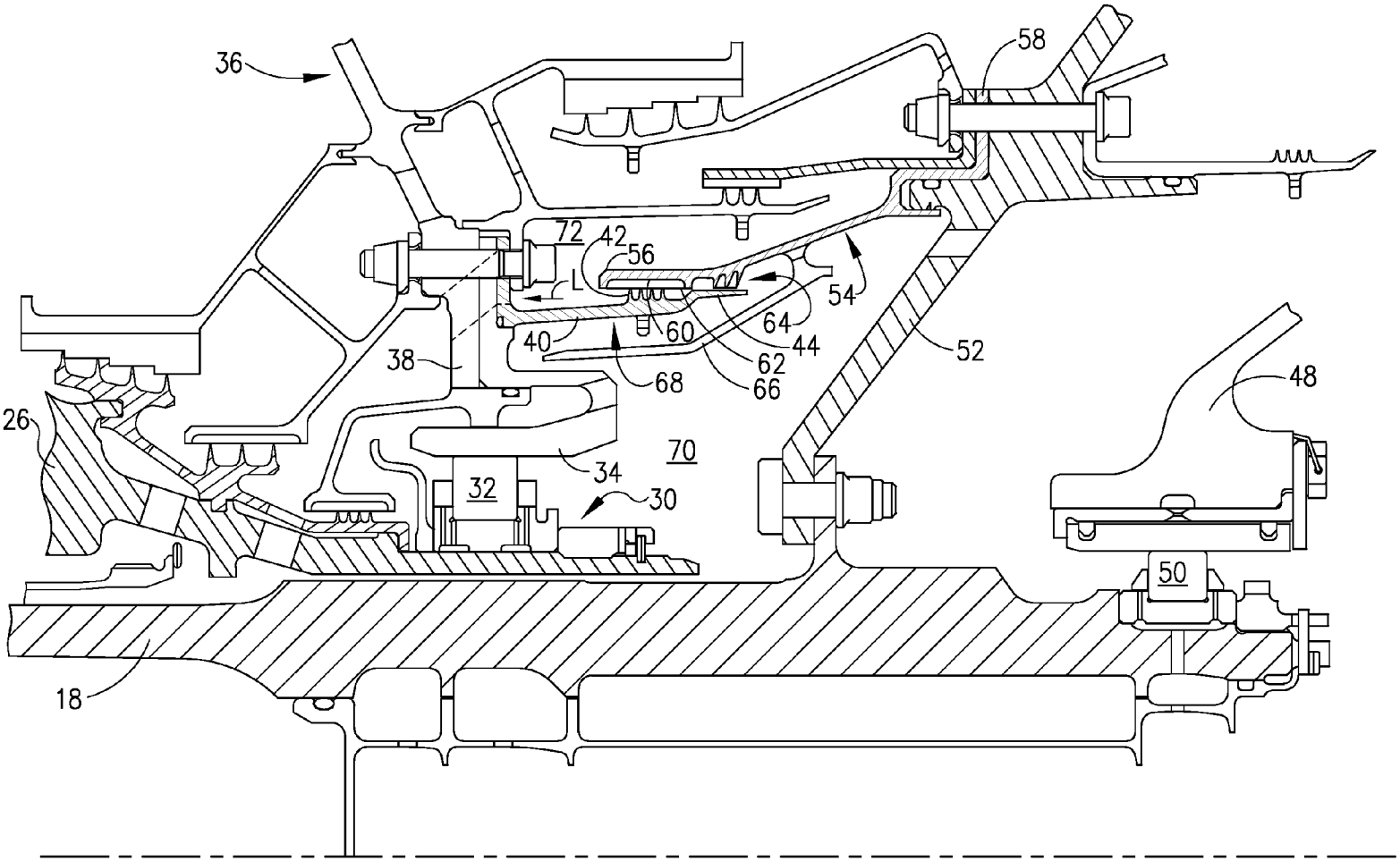
FIG. 2 is an enlarged view of a bearing compartment of the gas turbine engine of FIG. 1.
Figure 3:
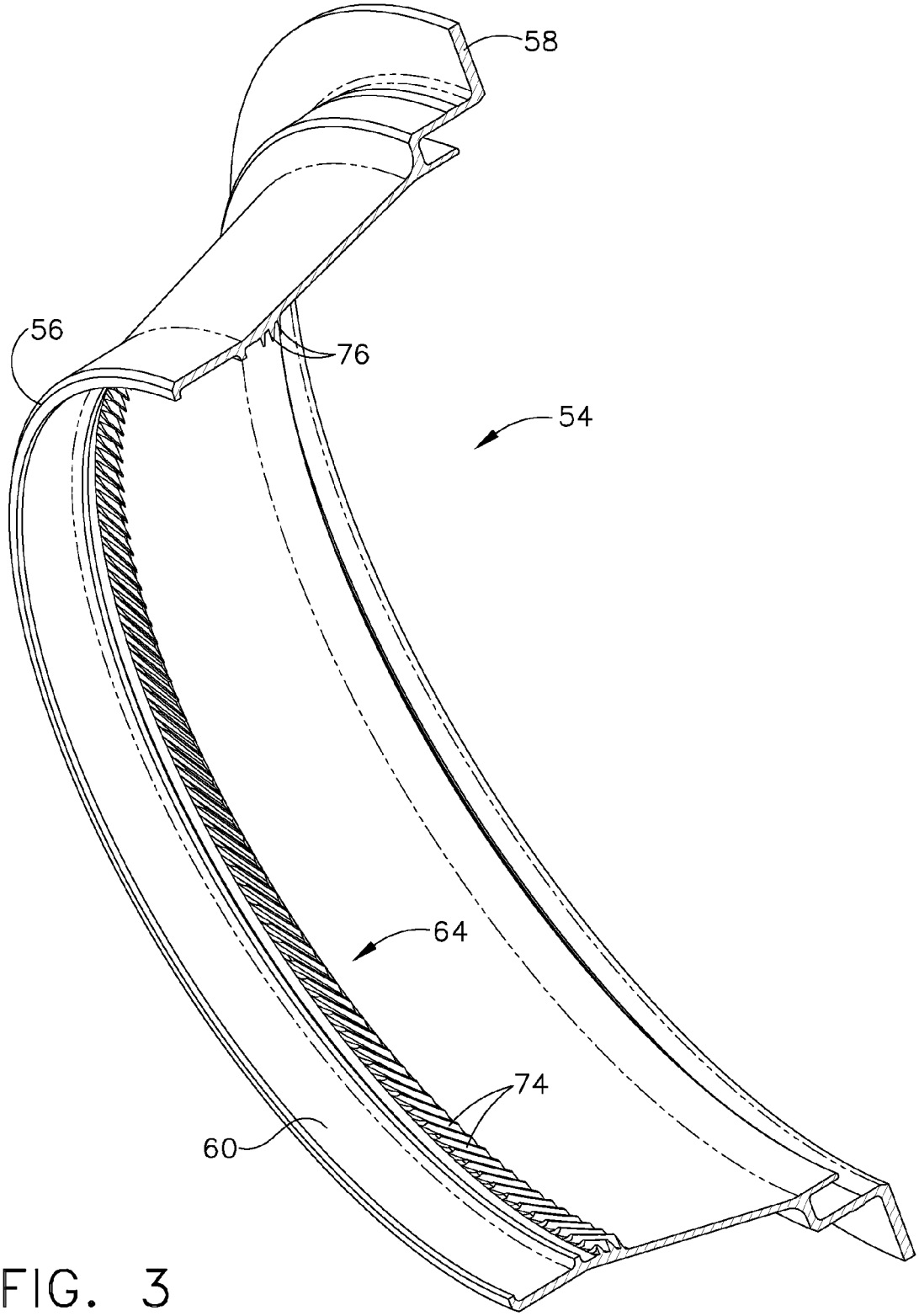
FIG. 3 is perspective cross-sectional view of a rotating seal shown in FIG. 2.

The inner and outer shafts 18 and 26 are mounted for rotation in several rolling-element bearings. The bearings are located in enclosed portions of the engine 10 referred to as "sumps". FIG. 2 shows an aft sump 28 of the engine 10 in more detail. The aft end 30 of the outer shaft 26 is carried by a bearing 32 which is referred to as the "#4R bearing", denoting its location and type. The outer race 34 of the bearing 32 is attached to a static annular frame member 36 of the engine 10. The frame member 36 has a main body portion 38 that extends in a generally radial direction. A stationary seal arm 40 extends axially aft from the main body portion 38. The distal end of the stationary seal arm 40 includes a number of annular seal teeth 42 which extend radially outwards, and at the extreme end, an annular sealing surface 44.

The aft end 46 of the inner shaft 18 extends aft of the outer shaft 26 and is mounted for rotation in a rear frame structure 48 of the engine by a rolling element bearing 50. The inner shaft 18 has a disk 52 extending generally radially outward from it. The disk 52 extends between the inner shaft 18 and the LP turbine 16 (see FIG. 1) and transmits torque between the LP turbine 16 and the inner shaft 18.

A rotating seal 54 extends axially forward from the disk 52. The rotating seal 54 has a generally frustoconical body with forward and aft ends 56 and 58, and its axis of rotation coincides with that of the engine 10. The forward end 56 of the rotating seal 54 includes a radially inward-facing seal pocket 60 which may contain a compliant seal material 62 of a known type such as abradable phenolic resin, a metallic honeycomb structure, a carbon seal, or a brush seal. Just aft of the seal pocket 60 is an impeller 64 which is described in more detail below. An annular, generally conical inner seal arm 66 extends axially forward from a point aft of the impeller 64. As seen in cross-section, the forward end 56 of the rotating seal 54 and the inner seal arm 66 overlap the stationary seal arm 40 in the axial direction.

The forward end of the rotating seal 54 overlaps the aft end of the stationary seal arm 40 in the axial direction, and the seal pocket 60 is aligned with the seal teeth 42 in the axial direction, so that they cooperatively form a rotating, non-contact seal interface 68. It is noted that the structure of the sealing components could be reversed; e.g. the rotating seal 54 could include radially-extending seal teeth while the stationary seal arm 40 could include a seal pocket. The impeller 64 is positioned adjacent the annular sealing surface 44 of the stationary seal arm 40.

Collectively, the outer shaft 26, the inner shaft 18, the disk 52, the stationary seal arm 40, and the rotating seal 54 define a "wet" cavity or "oiled" cavity 70. In operation, the bearing 32 is supplied with oil from a jet, supply line, or orifice in a known manner to provide lubrication and cooling. The interaction of the oil supply and the bearing 32 creates a mist of oil within the wet cavity 70. Because the wet cavity 70 is pressurized, air flow tends to transport the oil mist along a leakage path past the seal interface 68, as depicted by the arrow marked "L" in FIG. 2. This condition is worsened at low engine operating speeds when the air pressure in the "dry" cavity 72 adjacent the seal interface 68 is relatively low. This leakage causes oil loss which is undesirable from a cost, safety, and pollution standpoint. The function of the impeller 64 is to reduce or prevent this leakage.

Figure 4:
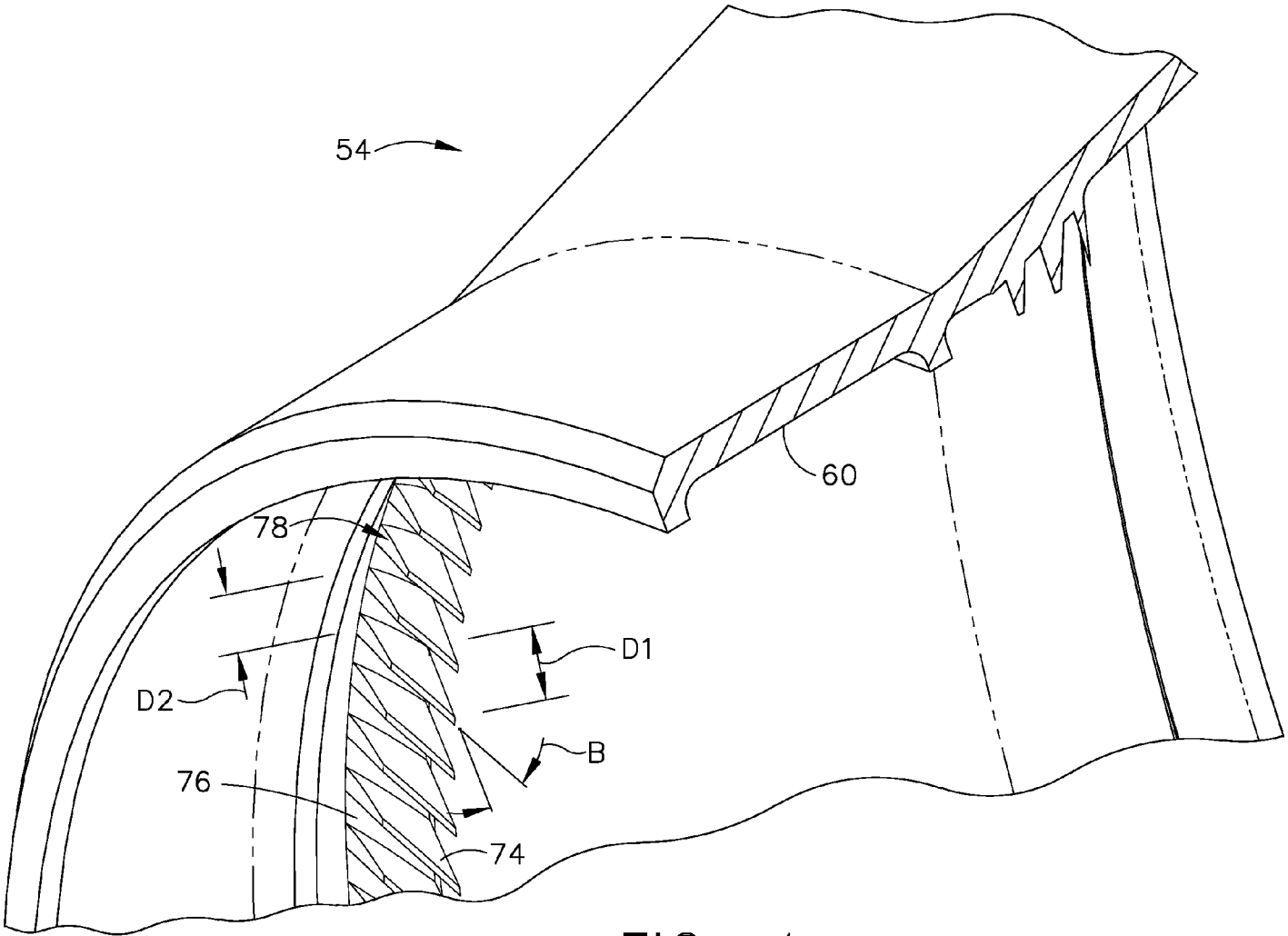
FIG. 4 is an enlarged view of a portion of FIG. 3.
Figure 5:
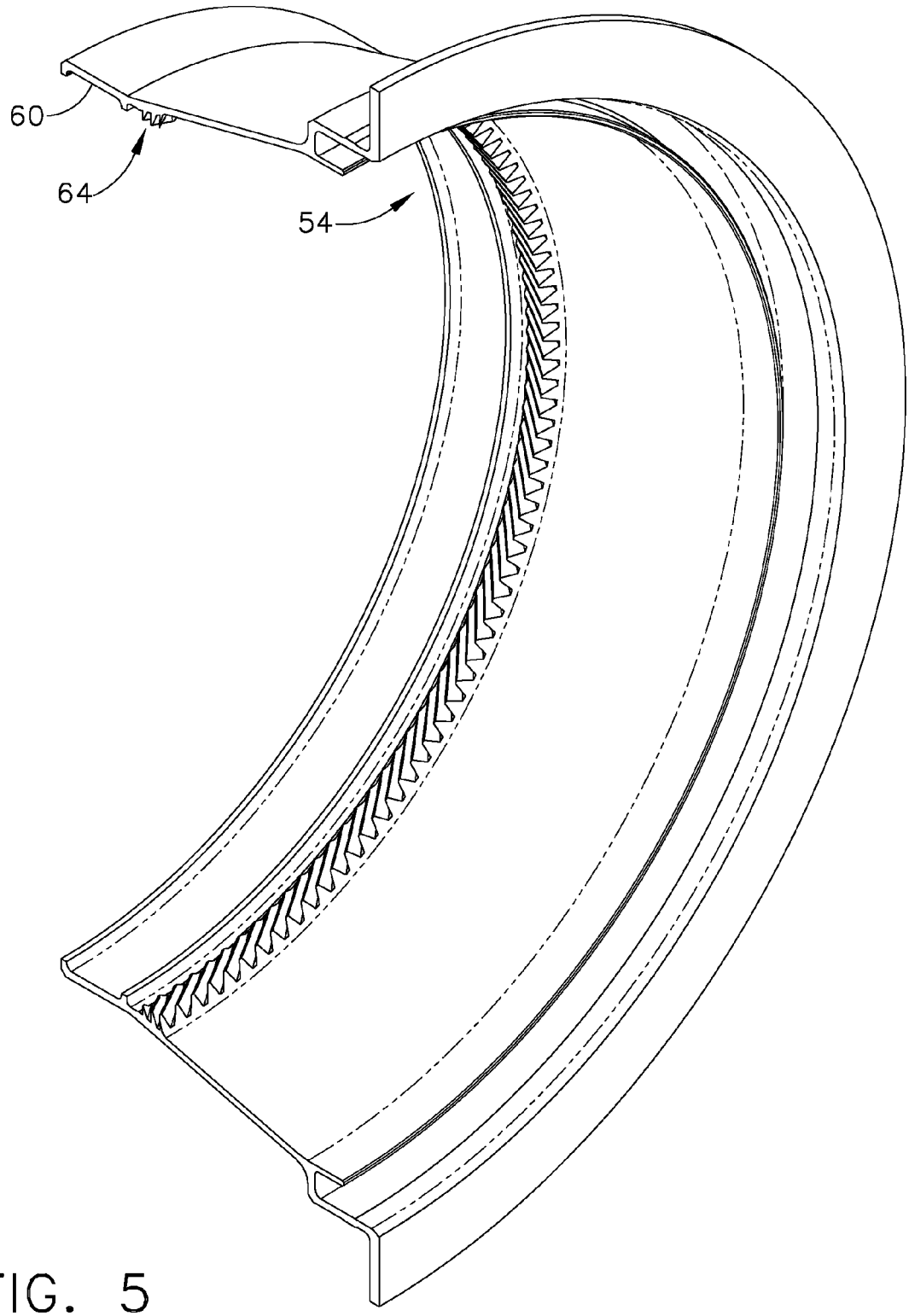
FIG. 5 is another perspective sectional view of the impeller of FIG. 3.
Figure 6:
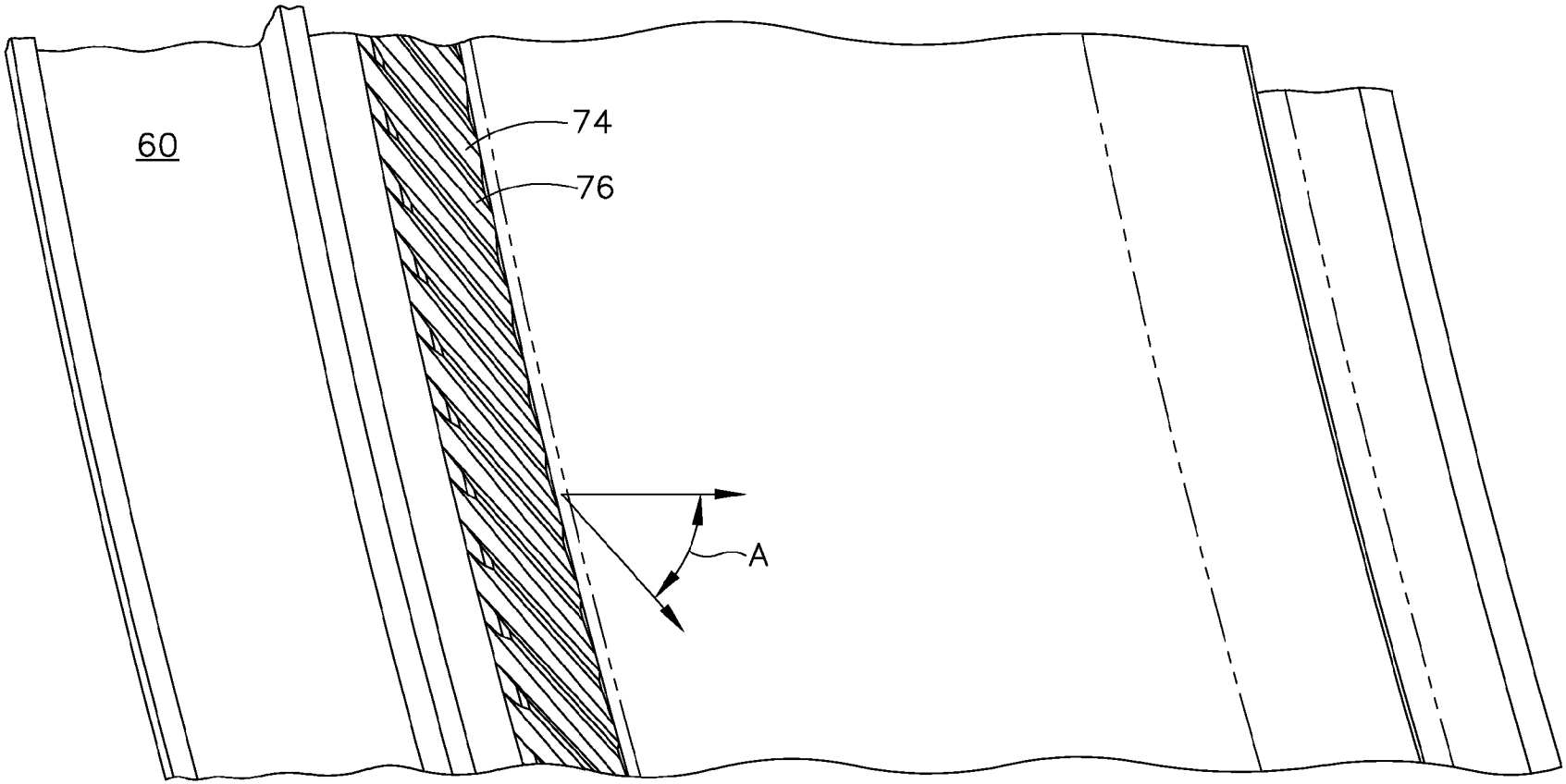
FIG. 6 is an enlarged view of a portion of the interior of the impeller shown in FIG. 3.

FIGS. 3-6 illustrate the rotating seal 54 in more detail. For illustrative clarity, the inner seal arm 66 is not shown in FIGS. 3-6. The impeller 64 comprises a ring of impeller blades 74 separated by grooves 76. The impeller blades 74 are oriented at an angle "A" to the rotational axis of the rotating seal 54 (see FIG. 6), and at an angle "B" in the measured from the radial direction, as seen in FIG. 4 (i.e. they are tangentially "leaned"). The angle of the impeller blades 74 can be optimized to ensure adequate axial driving force to keep air/oil mixture away from the sealing interface 68 at all operating conditions, in other words, at all speeds of the rotating seal 54 and at all expected air pressure gradients across the seal interface 68. In the illustrated example, angle A is about 45 degrees and angle B is about 20 degrees If desired, the impeller blades 74 may be given an airfoil cross-sectional shape. The grooves 76 between the impeller blades 74 form a series of radially diverging spiral-shaped pathways. Referring to FIG. 4, the radial depth "D1" of the grooves 76 at the aft edges of the impeller blades 74, is greater than the depth "D2" of the grooves 76 the forward edges of the impeller blades 74. The dimensions D1 and D2 may also be conceptualized as the radial span of the impeller blades 74. With this axially diverging channel configuration, oil collected at the root 78 of the impeller blades 74 will be driven by centrifugal force and channeled aft towards the wet cavity 70.

In comparison to a prior art windback seal, the centrifugal force, as a driving force, is much stronger than windage generated by air shearing. It is also much stronger than gravity effects on the oil which might resist oil drainage. Furthermore, because each of the grooves 76 is open at the aft end, much more open area for oil drainage is provided as compared to a windback. The impeller 64 thus allows oil to drain much easier than the traditional windback. Comparative computational fluid dynamics (CFD) analysis have shown substantially lower oil leakage flow with the impeller 64 of the present invention.

While the invention has described with respect to a particular bearing and seal arrangement, it is noted that the impeller 64 may be used in any sump or location in the engine where it is desirable prevent oil leakage.

The foregoing has described an oil seal with a dynamic impeller for a gas turbine engine. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

What is claimed is:

1. A rotating seal for a gas turbine engine, comprising:
(a) an annular seal body;
(b) a sealing component carried by the seal body which is adapted to form one-half of a rotating seal interface; and
(c) an impeller carried by the seal body which comprises a plurality of radially-inwardly-extending impeller blades, wherein the impeller blades are separated by grooves that define a plurality of radially diverging pathways.

2. The rotating seal of claim 1 wherein each of the impeller blades is oriented at a non-perpendicular, non-parallel angle to a longitudinal axis of the seal body.

3. The rotating seal of claim 2 wherein each of the impeller blades is oriented at an angle of about 45 degrees relative to a longitudinal axis of the seal body.

4. The rotating seal of claim 1 wherein each of the impeller blades is oriented at a non-perpendicular, non-parallel angle relative to a radial direction of the seal body.

5. The rotating seal of claim 4 wherein each of the impeller blades is oriented at an angle of about 20 degrees relative to a radial direction of the seal body.

6. The rotating seal of claim 1 wherein the sealing component is an annular seal pocket containing an abradable material.

7. The rotating seal of claim 1 wherein the sealing component is a carbon seal.

8. The rotating seal of claim 1 wherein the seal body has forward and aft ends, the sealing component is disposed at the forward end, and the impeller is disposed adjacent the sealing component.

9. A bearing assembly for a gas turbine, comprising:
(a) a rolling element bearing enclosed in a wet cavity;
(b) a stationary component forming a portion of a boundary between the wet cavity and a dry cavity;
(c) a rotating component disposed adjacent the stationary component and forming a portion of the boundary between the wet cavity and the dry cavity, wherein the stationary and rotating components cooperate to define a rotating seal interface between the wet and dry cavities; and
(d) an impeller carried by the rotating component which comprises a plurality of radially-extending impeller blades adapted to move oil away from the seal interface towards the wet cavity, wherein the impeller blades are separated by grooves that define a plurality of radially diverging pathways.

10. The bearing assembly of claim 9 wherein the stationary component is an annular seal arm.

11. The bearing assembly of claim 9 wherein each of the impeller blades is oriented at a non-perpendicular, non-parallel angle to a longitudinal axis of the rotating component.

12. The bearing assembly of claim 9 wherein each of the impeller blades is oriented at an angle of about 45 degrees relative to a longitudinal axis of the rotating component.

13. The bearing assembly of claim 12 wherein each of the impeller blades is oriented at a non-perpendicular, non-parallel angle relative to a radial direction of the rotating component.

14. The bearing assembly of claim 13 wherein each of the impeller blades is oriented at an angle of about 20 degrees relative to a radial direction of the rotating component.

15. The bearing assembly of claim 9 wherein the rotating component is an annular rotating seal comprising:

(a) an annular seal body; and (b) a sealing component carried by the seal body which is adapted to form one-half of the rotating seal interface.

16. The bearing assembly of claim 15 wherein the sealing component is an annular seal pocket containing an abradable material.

17. The bearing assembly of claim 15 wherein the sealing component is a carbon seal.

18. The bearing assembly of claim 15 wherein the rotating component has forward and aft ends, the sealing component is disposed at the forward end, and the impeller is disposed adjacent the sealing component.

* * * * *